US006210109B1

(12) United States Patent
Will et al.

(10) Patent No.: US 6,210,109 B1
(45) Date of Patent: Apr. 3, 2001

(54) PORTABLE FLUID BLOWER

(75) Inventors: Lawrence Will; Michael G. Comerford; Randall J. Griffin, all of Lake Zurich, IL (US)

(73) Assignee: Echo Incorporated, Lake Zurich, IL (US)

( * ) Notice: Subject to any disclaimer, the term of this patent is extended or adjusted under 35 U.S.C. 154(b) by 0 days.

(21) Appl. No.: 09/216,555

(22) Filed: Dec. 18, 1998

(51) Int. Cl.[7] ..... A47L 5/14
(52) U.S. Cl. ..... 415/204; 415/206; 416/183
(58) Field of Search ..... 415/202, 203, 415/204, 205, 206, 207, 208.1, 211.1; 416/188, 186 R, 183, 242, 223 B, 185

(56) References Cited

U.S. PATENT DOCUMENTS

| | | | | |
|---|---|---|---|---|
| Re. 36,627 | * | 3/2000 | Pink et al. | 15/347 |
| 3,537,544 | | 11/1970 | King . | |
| 4,260,037 | | 4/1981 | Eline . | |
| 4,279,325 | | 7/1981 | Challis . | |
| 4,289,096 | | 9/1981 | Latham et al. . | |
| 4,404,706 | * | 9/1983 | Loyd | 15/344 |
| 5,000,079 | | 3/1991 | Mardi . | |
| 5,040,943 | | 8/1991 | Dwyer et al. . | |
| 5,385,447 | * | 1/1995 | Geister | 415/220 |
| 5,620,370 | | 4/1997 | Umai et al. . | |
| 5,722,111 | * | 3/1998 | Sowell et al. | 15/330 |
| 5,743,710 | * | 4/1998 | Yapp | 415/208.2 |
| 5,810,557 | * | 9/1998 | Akinkuotu et al. | 415/206 |

FOREIGN PATENT DOCUMENTS 58-195098 * 11/1983 (JP) .

OTHER PUBLICATIONS

"The Role of the Computer in Turbocharger Design Development and Testing", K.S. Khan and P.J. Langdon.

* cited by examiner

*Primary Examiner*—Edward K. Look
*Assistant Examiner*—Liam McDowell
(74) *Attorney, Agent, or Firm*—Wood, Phillips, VanSanten, Clark & Mortimer

(57) ABSTRACT

A portable fluid blower having a housing defining an intake region for incoming fluid, an output region, and a fluid path for controllably communicating fluid entering the intake region to the output region at which fluid is discharged from the housing. An impeller on the housing is rotatable around a first axis and draws fluid into the fluid path through the intake region and accelerates fluid drawn into the fluid path so that the fluid drawn into the fluid path through the intake region is accelerated in the fluid path and discharged in an accelerated state at the output region. A drive rotates the impeller around the first axis. The fluid path has a first curved fluid path portion that extends at least partially around the first axis, and a second transition path portion through which fluid communicates from the input region towards the first curved fluid path portion. At least part of the second transition path portion is defined by a guide surface, that extends continuously around a central axis that is substantially coincident with the first axis, and has a diameter that increases progressively from the intake region axially relative to the central axis towards the first curved fluid path portion so that fluid moving from the intake region towards the first curved fluid path portion is guided progressively radially outwardly relative to the central axis through the part of the second transition path portion.

12 Claims, 4 Drawing Sheets

PORTABLE FLUID BLOWER

BACKGROUND OF THE INVENTION

1. Field of the Invention

This invention relates to blowers using an impeller to draw in and centrifugally accelerate a fluid for controlled discharge thereof.

2. Background Art

Portable power blowers are widely used by homeowners and professionals, particularly in the landscape and maintenance industries. The most popular version of the power blower is a hand-holdable, gas powered unit which uses a forwardly projecting discharge conduit that can be conveniently oriented to control air discharge by an operator in use. An impeller, with a laterally extending rotational axis, draws air inwardly as it rotates. In one construction, the impeller has an unbladed core volume with radially projecting blades having upstream ends at the core volume and downstream ends located radially outwardly therefrom. Operation of the impeller causes air to be drawn into the core volume, picked up by the blades, centrifugally accelerated in a volute, and diverted at a point of separation from the downstream ends of the blades at high volume to the discharge conduit.

The assignee herein offers a line of such blowers which are lightweight and capable of producing a high volume air discharge. One significant problem with these gas powered blowers is that they generate a significant amount of noise during operation. Designers are constantly seeking ways to attenuate the noise generated at different locations throughout the unit to make it more environmentally compatible.

The assignee herein has done a substantial amount of research regarding noise generation in this type of blower. One noise source is where laterally/axially directed incoming air encounters the impeller and abruptly stops and changes direction to a radial flow. The radial flow is in turn abruptly halted and redirected to a curved flow path around the impeller axis in the volute as the radial flow encounters the surface bounding the volute. This abrupt halting and redirection of air flow produces unwanted noise.

Another problematic noise source is at a branching location where the accelerated flow in the volute divides to be either a) directed through the discharge conduit or b) redirected into the volute for recirculation. Directly between these divided flow paths, the accelerated air is abruptly halted, which may generate significant noise as the impeller blades travel past this location and shear the air. Also, the air re-entering the volute passes through a restriction, where the volute has its smallest volume. The noise generation thereat can be reduced by enlarging the volume of the volute at the re-entry point. However, by doing this, the efficiency of the unit may be compromised. Thus, designers in the past have generally opted to produce a more efficient unit while contending with a significant amount of operating noise.

Aside from the noise generated by the air flow and air shearing by the impeller blade in operation, the gas powered drives for these impellers generate noise that must be independently contended with. Conventional two cycle engines generate a significant amount of noise in operation. Communities are now legislating to restrict noise levels to below those which many existing two cycle engines used on power blowers operate at. Whereas, in the past, noise reduction in this field was desired, this noise reduction is now becoming a necessity. The search for solutions to the noise problem has, or is soon likely to, become a priority for most manufacturers of this type of equipment.

One manner of reducing noise generation is to use a motor to drive the impeller which operates off of an AC or DC power source. The use of AC power may be impractical where a source of AC power is unavailable or not readily accessible.

With respect to DC power sources, current technology is such that DC power sources, portable enough to be moved in a practical manner with the equipment that is powered, have a relatively limited life before recharging is required. Equipment efficiency is paramount in systems operating using a DC power supply.

SUMMARY OF THE INVENTION

The invention is directed to a portable fluid blower having a housing defining an intake region for incoming fluid, an output region, and a fluid path for controllably communicating fluid entering the intake region to the output region at which fluid is discharged from the housing. An impeller on the housing is rotatable around a first axis and draws fluid into the fluid path through the intake region and accelerates fluid drawn into the fluid path so that the fluid drawn into the fluid path through the intake region is accelerated in the fluid path and discharged in an accelerated state at the output region. A drive rotates the impeller around the first axis. The fluid path has a first curved fluid path portion that extends at least partially around the first axis, and a second transition path portion through which fluid communicates from the input region towards the first curved fluid path portion. At least part of the second transition path portion is defined by a guide surface, that extends continuously around a central axis that is substantially coincident with the first axis, and has a diameter that increases progressively from the intake region axially relative to the central axis towards the first curved fluid path portion so that fluid moving from the intake region towards the first curved fluid path portion is guided progressively radially outwardly relative to the central axis through the part of the second transition path portion.

In one form, the impeller has an axial extent along the first axis and the guide surface extends over substantially the entire axial extent of the impeller.

The impeller may have a plurality of blades each having a length extending axially relative to the first axis.

In one form, one of the blades has a length that is less than the length of another of the blades.

The blades may be reversely curved along the lengths of the blades.

In one form, the plurality of blades includes a plurality of blades having a first length and a plurality of blades having a second length that is different than the first length, with there being a blade having the first length between two blades having the second length and a blade having the second length between two blades having the first length.

The blades having the first and second lengths may alternate around the entire circumference of the impeller.

In one form, each of the blades projects radially from the guide surface relative to the first axis and the amount of radial projection for each blade varies over the length of each blade.

In one form, each blade has an upstream edge and a downstream edge and the upstream edge of one of blades is substantially straight and orthogonal to the central axis.

The upstream edge of a second blade may be substantially straight and orthogonal to the central axis, with the upstream edges of the one and second blades being substantially parallel to each other and diametrically oppositely located relative to the central axis.

The downstream edge of one of the blades may be substantially straight and parallel to the central axis.

In one form, the impeller has a diameter and an edge at a location where the diameter of the impeller is the largest and the downstream edge of the blade is substantially flush with the edge at the location where the diameter of the impeller is the largest.

A cup-shaped element may be provided at the upstream end of the impeller and has a surface that blends into the guide surface.

In one form, the impeller rotates in a drive direction and the blades have a leading surface which is inclined in the drive direction.

The drive may be one of a gas powered drive, a drive operated by an alternating current power source, and a drive operated by a direct current power source.

The housing may have a surface with a funnel-shaped portion adjacent to the intake region.

In one form, the blades each have an edge that faces radially outwardly relative to the central axis and the housing has a wall with a surface that conforms to the radially outwardly facing edges over substantially the entire extent of the radially outwardly facing edges.

In one form, the radially outwardly facing edges have a serpentine shape.

In one form, the housing defines a volute which defines the first curved fluid a path portion, and the volute extends substantially fully around the central axis.

In one form, the housing has a discharge conduit defining the output region, the volute has an inlet portion and an outlet portion and fluid entering the intake region and communicating to the intake portion of the volute is centrifugally accelerated and moves through the volute to the output region and is discharged from the housing at the discharge conduit.

In one form, viewing the fluid blower axially relative to the central axis, the blades move in a path having a first diameter and the housing defines an intake opening at the intake region with a diameter that is less than the first diameter.

In one form, the diameter of the intake opening may be on the order of one-half the first diameter.

In one form, the housing has a first surface facing axially relative to the first axis toward the intake opening and a second surface facing radially outwardly relative to the first axis and the first and second surfaces meet to define an annular corner. The guide surface overlaps the annular corner in an axial direction relative to the first axis.

In one form, there is a transition wall between the inlet portion and outlet portion of the volute and the transition wall has a generally flat first surface which resides in a plane that is not parallel to the first axis.

The transition wall may have a generally flat second surface which defines a V shape in conjunction with the first surface.

The first and second surfaces may join along a line that is not parallel to the first axis.

The invention is also directed to a portable fluid blower having a housing defining an intake region for incoming fluid, an output region, and a fluid path for controllably communicating fluid entering the intake region to the output region at which fluid is discharged from the housing. An impeller on the housing is rotatable around a first axis and draws fluid into the fluid path through the intake region and accelerates the fluid drawn into the fluid path so that fluid drawn into the fluid path through the intake region is accelerated in the fluid path and discharged in an accelerated state at the output region. A drive rotates the impeller around the first axis. The housing and impeller have cooperating surfaces at the second transition path portion which guide fluid moving from the intake region towards the first curved fluid path portion progressively radially outwardly relative to the central axis through the second transition path portion.

DETAILED DESCRIPTION OF THE DRAWINGS

Figure 1:
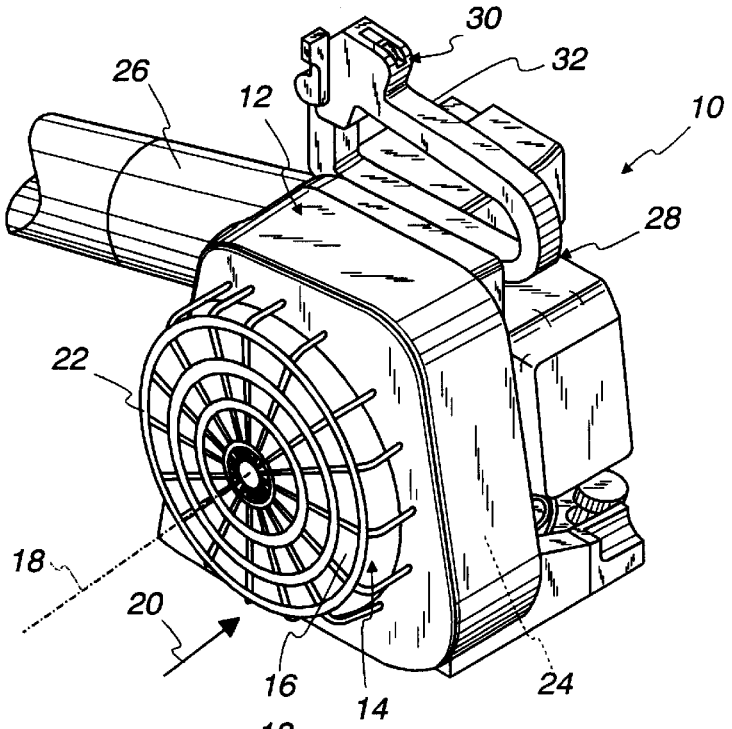
Fig. 1 (Prior Art)
FIG. 1 is a fragmentary, perspective view of a conventional portable blower.
Figure 2:
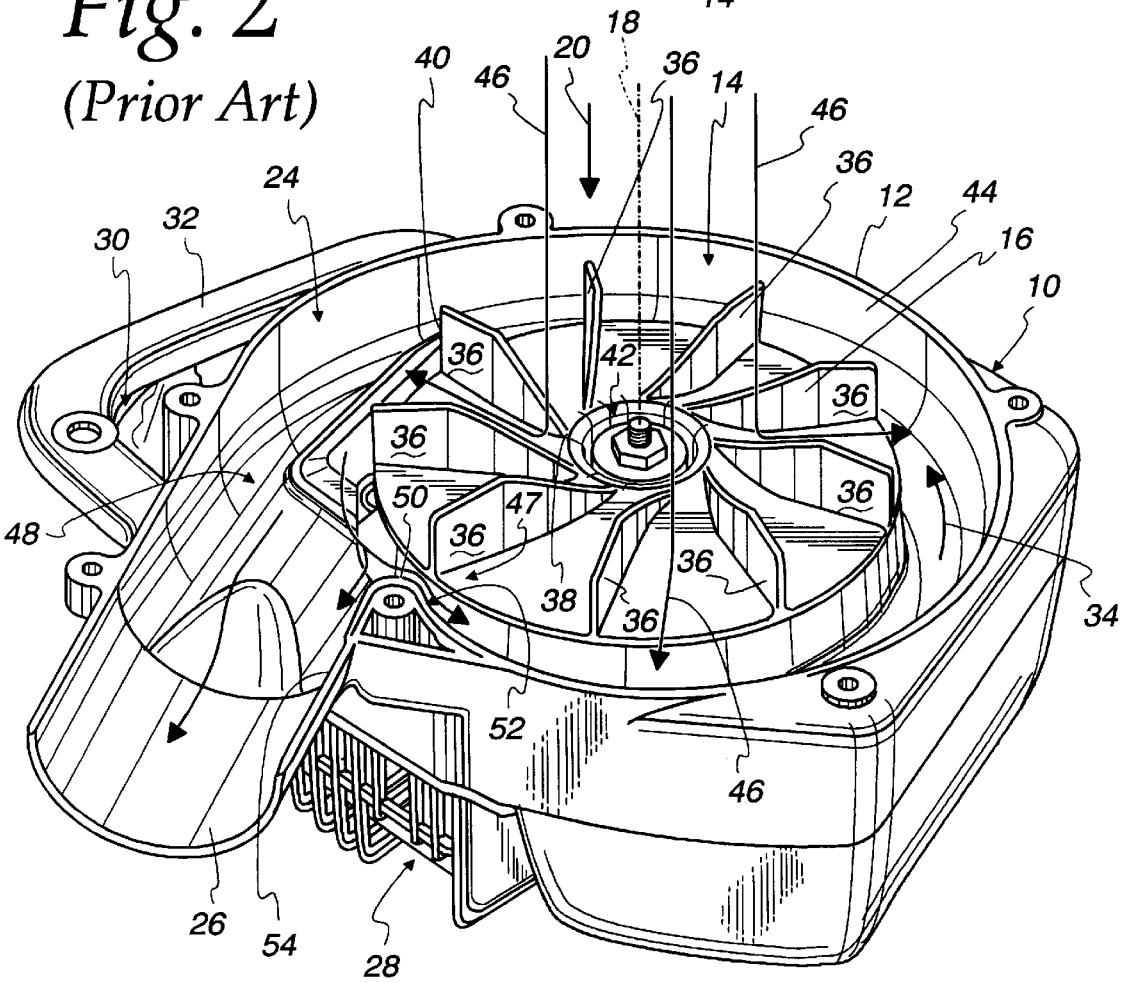
Fig. 2 (Prior Art)
FIG. 2 is an enlarged, perspective view of the blower in FIG. 1 with part of the housing thereon removed.

In FIGS. 1 and 2, a conventional hand-holdable blower unit is shown at 10. The blower unit 10 has a housing 12 defining an internal space 14 within which air is accelerated. More particularly, the blower unit 10 has a bladed impeller 16, which rotates around a laterally extending axis 18 to draw air axially inwardly, as indicated by the arrow 20, through a grill 22. The impeller 16 directs the incoming air radially outwardly into a volute 24 in which the air is centrifugally accelerated and ultimately communicated to and through a discharge conduit 26. In this embodiment, the impeller 16 is rotated by a gas powered motor 28 which is regulated by controls 30 on a carrying handle 32 for the blower unit 10.

In FIG. 2, the precise air flow pattern into and through the blower unit can be seen. The motor 28 drives the impeller 16 in the direction of the arrow 34. The impeller 16 has radially projecting blades 36 which are spaced uniformly around the axis 18 of the impeller 16. Each blade has an upstream end 38 and a radially outwardly spaced downstream end 40. Between the axis 18 and the upstream ends 38 of the blades 36, a core volume 42 is defined. The core volume 42 does not have any air accelerating blades therewithin.

As the impeller 16 is driven, the blades 36 centrifugally propel air against the radially inwardly facing surface 44 of the volute 24. A low pressure region is thereby developed in the core volume 42, as a result of which intake air is drawn axially/laterally through the air intake grill 22 and into the core volume 42. The arrows 46 indicate the air flow pattern. Initially, the air flows axially and at the impeller 16 abruptly changes direction to flow in a radial direction. The radial flow again abruptly changes direction upon encountering the radially inwardly facing surface 44, whereupon the air moves in a curved path in the direction of the arrow 34 around the axis 18 through the volute.

The volute 24 has an inlet region 47 and an outlet region 48, with the outlet region 48 communicating directly with the discharge conduit 26. Air moving through the volute 24 from the inlet region 46 is accelerated and expanded, in a progressively increasing volume of the volute 24, from where it communicates to the outlet region 48.

The blower unit 10 has a number of areas at which noise generation is significant. At the point where the air flow changes from axial to radial flow at the impeller 16, significant noise can be generated as the blades 36 "shear" the air.

There also may be significant noise generation where the air changes from a radial flow path to a centrifugal flow path in the volute 24.

A further area of noise generation is at the cut-off point/juncture 50 where the air accelerated by the impeller 16 branches to either travel through the discharge conduit 26 or re-enter the volute 24 at the inlet region 47. The cut-off point/juncture 50 is at the juncture of two generally flat surfaces 52, 54. The planes of the surfaces 52, 54 are substantially parallel to the axis 18. At the cut-off point/juncture 50 between the surfaces 52, 54 there is a stagnation point at which the accelerated air abruptly stops. The stagnated air is sheared by the blades 36, which again may produce a significant amount of noise.

Figure 3:
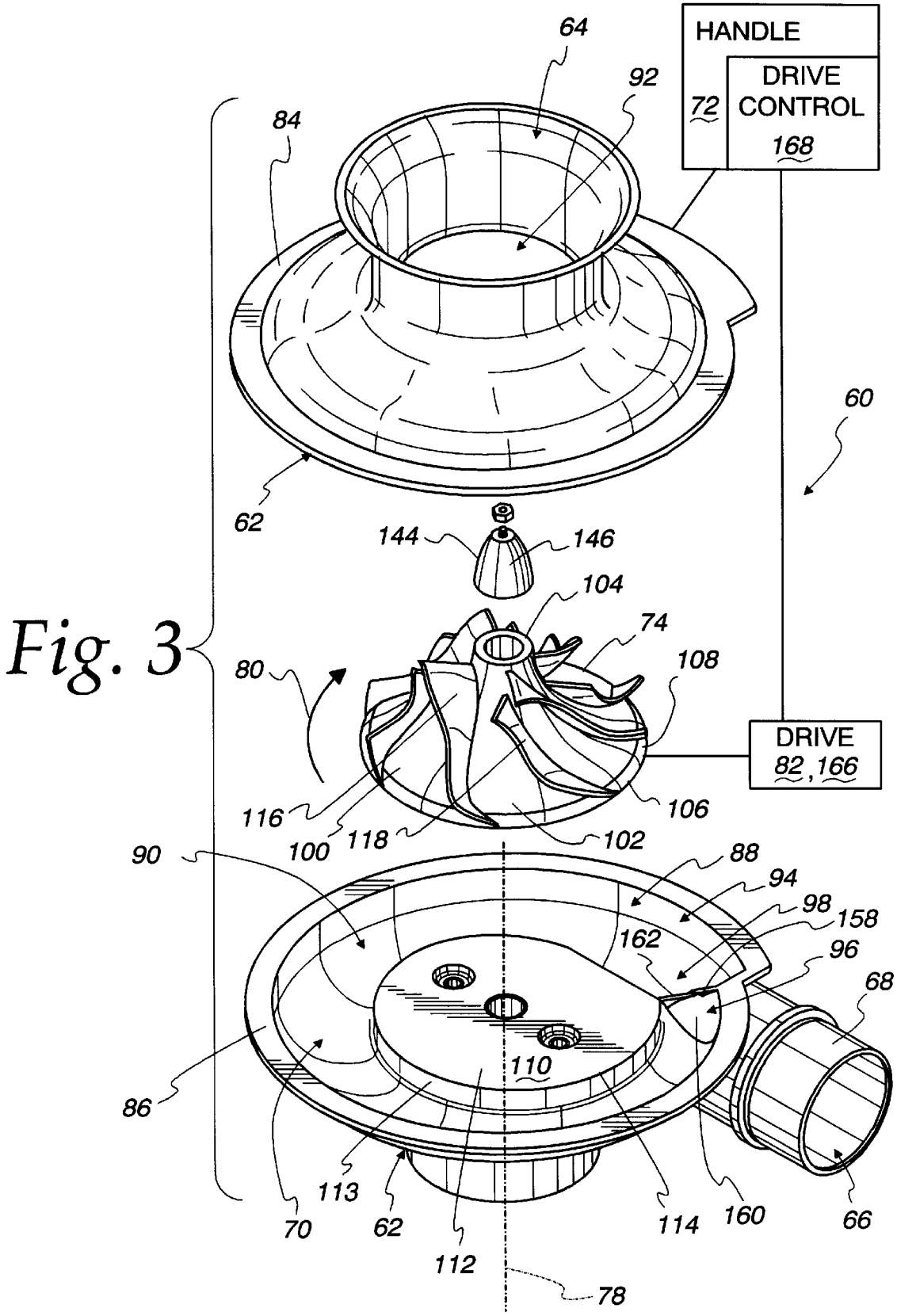
FIG. 3 is an exploded, perspective view of a portable fluid blower, according to the present invention.
Figure 4:
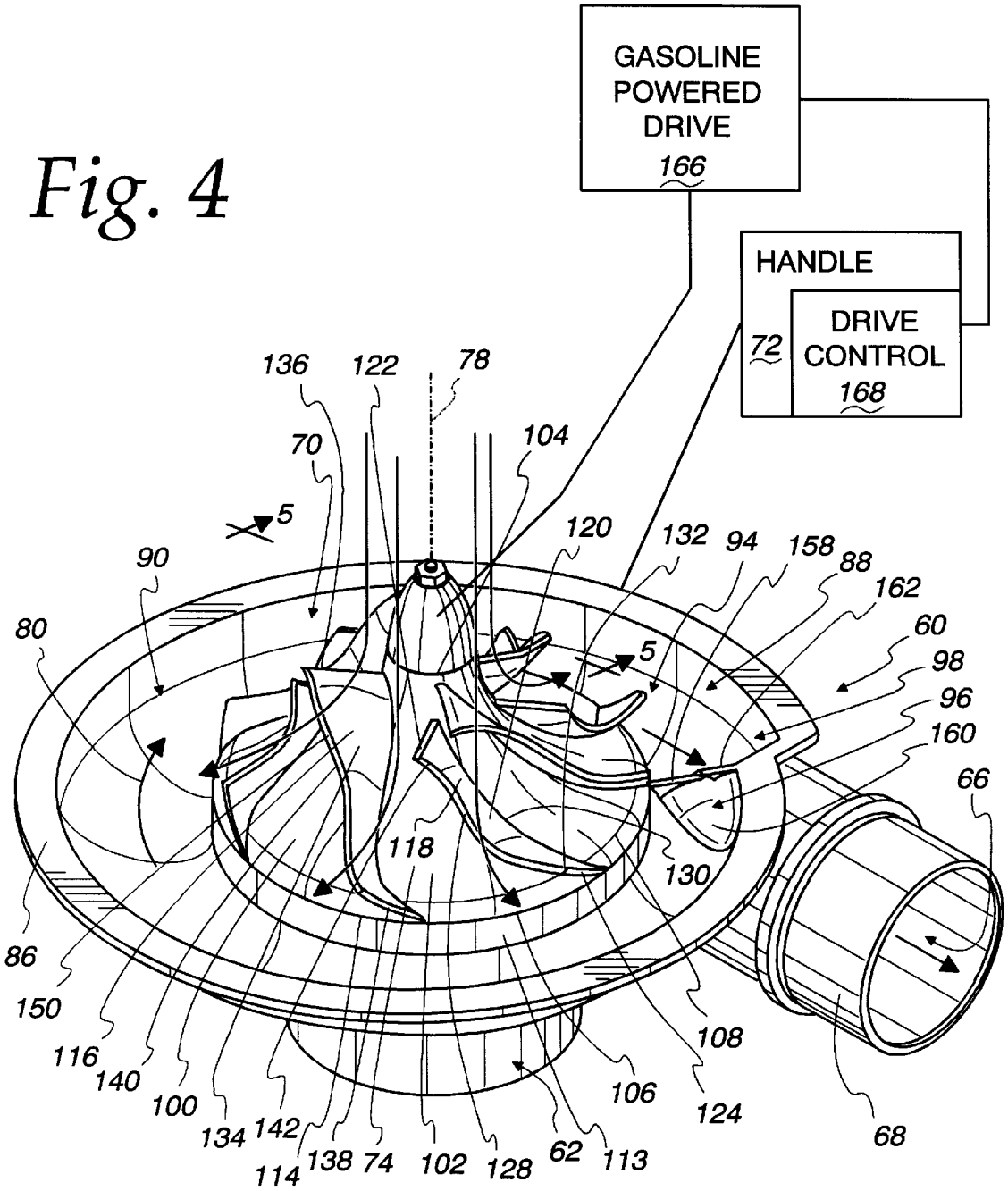
FIG. 4 is an enlarged, perspective view of a part of a housing on the blower in FIG. 3 with an impeller in operative position thereon.
Figure 5:
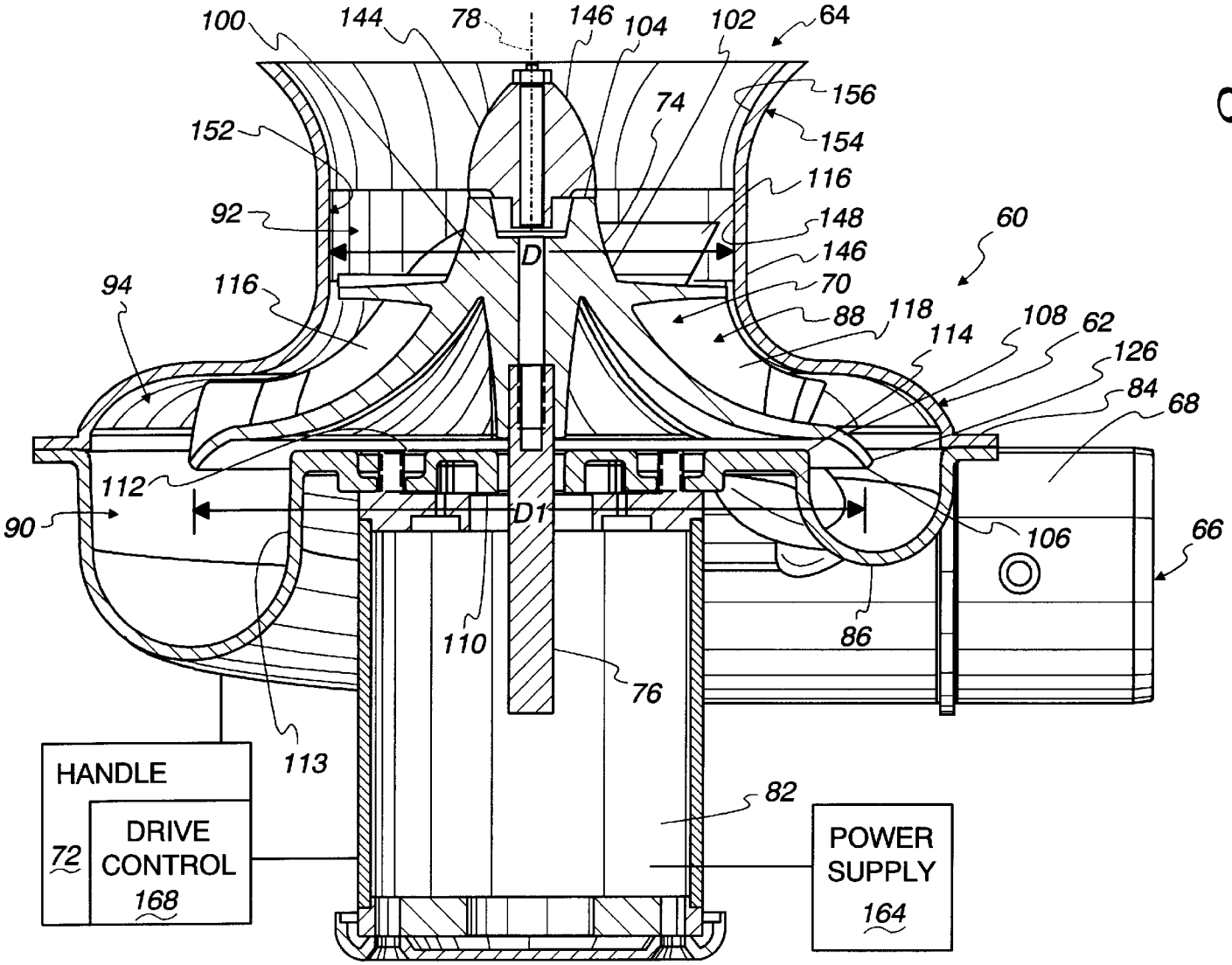
FIG. 5 is an enlarged, cross-sectional view of the fluid blower taken along line 5—5 of FIG. 4.

A portable fluid blower, according to the present invention, is shown in FIGS. 3–5 at 60. The blower 60 has a housing 62 which defines an intake region 64 for incoming fluid, an output region 66, at which a discharge nozzle 68 is provided, and internal fluid flow path/acceleration space 70 for controllably communicating fluid entering the intake region 64 to the output region 66 at which fluid is discharged from the housing 62. The housing 62 has a handle 72, which is shown schematically, but which may take any form convenient to hold the housing 62 in an operative orientation.

An impeller 74 is mounted on a shaft 76 for rotation around an axis 78 in the direction of the arrow 80. A drive 82 rotates the impeller around the axis 78 to draw fluid towards and into the fluid path 70 through the intake region 64 and accelerate the intake fluid in the fluid path 70 for ultimate discharge in an accelerated state at the output region 66 in substantially a straight flow path that is transverse to the axis 78.

The housing 62 is defined by first and second joinable parts 84, 86, which cooperatively bound a chamber 88 within which the impeller 74 operates.

The fluid path 70 consists of a curved path portion at 90 around the axis 78 and a transition path portion 92 through which fluid communicates from the intake region 64 towards the curved path portion 90.

The curved path portion 90 is defined by a volute 94 with an inlet region 96 and an outlet region 98, corresponding to the inlet and outlet regions 46, 48 described for the blower unit 10. The cross-sectional area, and thus the volume of the volute 94, as seen clearly in FIG. 5, increases progressively from the inlet region 96 to the outlet region 98.

The general operation of the fluid blower 60 is the same as that of the blower unit 10, previously described. That is, fluid entering at the intake region 64 is directed through the transition path portion 92 into the curved path portion 90 defined by the volute 94 and centrifugally accelerated from the inlet region 96 to the outlet region 98 thereof at which point accelerated fluid is discharged through the nozzle 68 defining the output region 66.

The impeller 74 has the same overall shape as a compressor wheel on a conventional turbocharger. The impeller 74 has a body 100 with a guide surface 102 that extends continuously, and is symmetrical, around a central axis that is coincident with the axis 78. The guide surface 102 increases in radius progressively from an upstream end 104 to a downstream end 106. The guide surface 102 has a concave curvature from the upstream end 104 to an axial location 108 adjacent to the downstream end 106, at which point the curvature becomes convex.

The housing 62 has a mounting wall 110 through which the impeller shaft 76 extends. The mounting wall 110 has an axial facing, flat surface 112 which meets a radially outwardly facing surface 113 bounding a part of the volute 94 at an annular corner 114. The guide surface 102 extends radially inwardly beyond the corner 114 and shrouds the corner 114 by axially overlapping the corner 114.

The impeller 74 has a series of circumferentially spaced blades, including blades 116 of a first configuration and blades 118 of a second configuration which alternate around the entire circumference of the guide surface 102. Each blade 116, 118 has a length extending around the axis 78. The blades 116, 118 have the same general shape, however the blades 118 have both a lesser radial and axial extent than the blades 116.

Exemplary blade 118, as seen in FIG. 4, has a generally flat body 120 with an upstream edge 122 and a downstream edge 124. The upstream edge 122 is substantially straight and is aligned to extend through the axis 78 substantially orthogonally thereto. The downstream edge 124 is substantially flush with the downstream end 126 (FIG. 5) of the guide surface 102 where the diameter of the impeller 74 is the largest, is straight, and extends substantially in a line that is parallel to the axis 78. A radially facing edge 128 is reversely curved in the shape of an S between the upstream edge 122 and downstream edge 124. The body 20 has a serpentine shape over its length. The body 120 is slightly curved along lines extending through a root edge 130, where the blade 118 joins to the guide surface 102, and the radially facing edge 128. The radial projection of the radially facing edge 128 from the guide surface 102 decreases from the upstream edge 122 towards the downstream edge 124 up to a transition point 132 at which the downstream edge 124 and radially facing edge 128 meet.

In the embodiment shown, eight blades 116, 118 are provided on the impeller 74. With this arrangement, the upstream edges 122 of two diametrically opposite blades 118 extend along a common line and through the axis 78.

The blades 116 have the same general construction as the blades 118, including flat, reversely curved bodies 134 with straight upstream and downstream edges 136, 138 having the same orientation as the upstream and downstream edges 122, 124. The upstream edges 136 on diametrically opposite blades 116 have aligned lengths which extend through the axis 78. The downstream edges 138 extend substantially parallel to the axis 78.

The blades 116, 118 have leading surfaces 140, 142 which are inclined in the direction of rotation of the impeller 74.

At the upstream end of the impeller 74, an unbladed, cup-shaped element 144 is attached. The cup-shaped element 144 has a convex outer surface 146 which smoothly blends into the guide surface 102.

As seen in FIG. 5, the first housing part 84 has a wall 147 with a surface 148 that conforms to the radially facing edges 128 of the blades 118, and the corresponding edges 150 of the blades 116 over substantially the entire extent of the blade edges 128, 150. A slight gap, on the order of ⅛th inch, is maintained between the radially facing edges 128 and wall surface 148.

The wall 146 on the first housing part 84 has a substantially uniform diameter portion at 152 adjacent to the upstream blade edges 122, 136 and diverges axially outwardly therefrom to define a funnel-shaped portion at 154. The diameter D of the intake opening 156 defined by the housing part 84 is on the order of ½ the diameter D1 traced by the downstream edges 124, 138 of the blades 116, 118.

In operation, intake fluid is funneled into the intake opening 156 at the intake region 64 and is directed by the guide surface 102 progressively radially outwardly through the transition path portion 92 to the path portion 90 defined by the volute 94. Abrupt direction change for the fluid is avoided as the fluid enters the volute 94.

At the same time, the configuration of the impeller 74 avoids the shearing action that occurs at a cut-off point/juncture 158, corresponding to the cut-off point/juncture 50 in the blower unit 10. The cut-off point/juncture 158 is at the apex of a V defined where two flat surfaces 160, 162 meet to define a transition wall. The planes of the surfaces 160, 162 are inclined from an axial alignment with the axis 78. The line of the apex between the surfaces 160, 162 makes an acute angle with the axis 78.

The drive 82 for the impeller 74 is shown as a motor 82 which is driven by a power supply 164 which may be an AC or DC power supply.

Alternatively, the impeller 74 can be driven by a gasoline-powered drive 166, shown in FIG. 4.

Regardless of the nature of the drive, it is desirable that the user have a readily accessible control 168 that is commonly provided directly on the handle 72.

While the drive could take any form, the inherent efficiency of the impeller 74 having the above construction make it particularly suitable to be operated by a DC power supply. A motor with a DC power supply has the advantage that it can be made to operate at reduced noise levels compared to gasoline-powered drives with height efficiencies built in, the impeller 74 can be rotated at speeds to produce the same air volume as in some conventional impellers rotated at higher speeds. This translates into longer DC power supply life before recharge is necessary and lower levels of operating noise.

The foregoing disclosure of specific embodiments is intended to be illustrative of the broad concepts comprehended by the invention.

What is claimed is:

1. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a tart of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein one of the blades has a length that is less than the length of another of the blades.

2. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein the blades are reversely curved along the lengths of the blades.

3. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein the plurality of blades comprise a plurality of blades having a first length and a plurality of blades having a second length that is different than the first length, and there is a blade having the first length between two blades having the second length and a blade having the second length between two blades having the first length on the impeller.

4. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein the plurality of blades comprise a plurality of blades having a first length and a plurality of blades having a second length that is different than the first length, and there is a blade having the first length between two blades having the second length and a blade having the second length between two blades having the first length on the impeller, wherein the impeller has a circumference and the blades having the first and second lengths alternate around the entire circumference of the impeller.

5. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein each of the blades projects radially from the guide surface relative to the first axis and the amount of radial projection for each blade varies over the length of each blade.

6. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein the impeller has axially spaced upstream and downstream ends and there is an unbladed, cup-shaped element at the upstream end of the impeller with a surface that blends into the guide surface.

7. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the impeller comprises a plurality of blades each having a length extending axially relative to the first axis, wherein the impeller rotates in a drive direction and the blades have a leading surface which is inclined in the drive direction.

8. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided by the guide surface progressively radially outwardly relative to the central axis through the part of the second transition path portion, wherein the impeller comprises a plurality of blades each having a length extending axially relative to the first axis, wherein the blades each have an edge that faces radially outwardly relative to the central axis and the housing has a wall with a surface that conforms to the radially outwardly facing edges over substantially the entire extent of the radially outwardly facing edges, wherein the radially outwardly facing edges each have a serpentine shape.

9. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided by the guide surface progressively radially outwardly relative to the central axis through the part of the second transition path portion, wherein the housing defines a volute which defines the first curved fluid path portion and the volute extends substantially fully around the central axis, wherein the housing comprises a discharge conduit defining the output region, the volute has an inlet portion and an outlet portion, and fluid entering the intake region and communicating to the inlet portion of the volute is centrifugally accelerated and moves through the volute to the output region and is discharged from the housing at the discharge conduit, wherein the housing has a first surface facing axially relative to the first axis toward the intake region and a second surface facing radially outwardly relative to the first axis and the first and second surfaces meet to define an annular corner and the guide surface overlaps the annular corner in an axial direction relative to the first axis.

10. A portable fluid blower comprising:

a housing defining an intake region for incoming fluid, an output region, and a fluid path for controllably communicating fluid entering the intake region to the output region at which fluid is discharged from the housing;

an impeller on the housing which is rotatable around a first axis and which draws fluid into the fluid path through the intake region and accelerates fluid drawn into the fluid path so that fluid drawn into the fluid path through the intake region is accelerated in the fluid path and discharged in an accelerated state at the output region; and a drive for rotating the impeller around the first axis, wherein the fluid path comprises a first curved fluid path portion which extends at least partially around the first axis and a second transition path portion through which fluid communicates from the input region towards the first curved fluid path portion, wherein at least a part of the second transition path portion is defined by a guide surface that extends continuously around a central axis that is substantially coincident with the first axis and has a diameter that increases progressively from the intake region axially relative to the central axis toward the first curved fluid path portion so that fluid moving from the intake region toward the first curved fluid path portion is guided progressively radially outwardly relative to the central axis through the part of the second transition path portion, wherein the housing defines a volute which defines the first curved fluid path portion and the volute extends substantially fully around the central axis, wherein the housing comprises a discharge conduit defining the output region, the volute has an inlet portion and an outlet portion, and fluid entering the intake region and communicating to the inlet portion of the volute is centrifugally accelerated and moves through the volute to the output region and is discharged from the housing at the discharge conduit, wherein there is a transition wall between the inlet portion and the outlet portion of the volute and the transition wall has a generally flat first surface which resides in a plane that is not parallel to the first axis.

11. The portable fluid blower according to claim 10 wherein the transition wall has a generally flat second surface which defines a V shape in conjunction with the first surface.

12. The portable fluid blower according to claim 11 wherein the first and second flat surfaces join along a line that is not parallel to the first axis.

* * * * *